United States Patent [19]

Hucknall

[11] Patent Number: 4,984,331

[45] Date of Patent: Jan. 15, 1991

[54] DOOR HOLDER INCLUDING A REMOVABLE CAM

[76] Inventor: Richard Hucknall, 3 Fairview Ave., Great Neck, N.Y. 11023

[21] Appl. No.: 214,407

[22] Filed: Jul. 5, 1988

Related U.S. Application Data

[63] Continuation-in-part of Ser. No. 810,222, Dec. 18, 1985, Pat. No. 4,754,522.

[51] Int. Cl.[5] ..... E05F 3/04

[52] U.S. Cl. ..... 16/51; 16/71; 16/323; 16/233; 16/DIG. 17

[58] Field of Search ..... 16/49, 51, 66, 71, 323, 16/333, DIG. 9, DIG. 10, DIG. 17

[56] References Cited

U.S. PATENT DOCUMENTS

| | | | |
|---|---|---|---|
| 1,515,155 | 11/1924 | Meagher | 16/41 |
| 1,931,178 | 10/1933 | Carlson | 16/66 X |
| 2,277,316 | 3/1942 | Garrison | 16/DIG. 17 X |
| 2,940,111 | 6/1960 | Patriquin | 16/66 |
| 3,289,242 | 6/1966 | Mallory | 16/66 |
| 3,543,327 | 12/1970 | Nilsson | 16/49 |
| 4,754,522 | 7/1988 | Hucknall | 16/51 |

*Primary Examiner*—Fred A. Silverberg

*Attorney, Agent, or Firm*—Robert R. Strack

[57] ABSTRACT

A door holding mechanism for use with closure devices, having interacting members connected to the door that selectively, by touch, effect locking or sliding movement to permit unrestricted door movement or rigid positioning in one or more positions.

8 Claims, 8 Drawing Sheets

DOOR HOLDER INCLUDING A REMOVABLE CAM

This is a continuation-in-part of copending patent application Ser. No. 810,222, filed on Dec. 18, 1985, now U.S. Pat. No. 4,754,522. The invention relates to door holders, and more particularly, to door holders operative to selectively position the door responsive to movement of the door itself.

BRIEF DESCRIPTION OF THE INVENTION

1. Description of the Prior Art

The function of securing doors, lids, hatches, and other closure devices, in an open or partially open position, has been carried out in a variety of ways. Hooks are used to fasten open doors to adjacent walls. Chains are frequently used to permit doors to rest in positions determined by the length of the chain. Wedges and blocks are used to restrict door movement. When hydraulic closers are part of the system, means may be provided for restraining movement of the piston arm.

Most door holding devices require an operator to manually set them into the desired position. This, in turn, presupposes that the operator has his hands free to manipulate the devices. Many devices must be seen to permit the operator's manual adjustment, and cannot be easily set in conditions where the light is dim, or nonexistant. A large majority of door holding devices require some degree of manual dexterity and some cannot be manipulated by persons with physical handicaps.

Because door holding devices are often installed by "do-it-yourselfers", they should be strong, trouble free, and adaptable to the wide variety of conditions that occur. It is also necessary to consider the size, position, and configuration of cooperating structures. Heavy duty components, threaded fasteners, and non-critical component dimensions often play an important part in the design of such devices.

2. The Present Invention

The present invention is a door holder suitable for attachment to almost all hinged or pivoted closure members, which are biased to a closed condition, by springs, gravity, or other means. The invention permits unrestricted opening and closing of such a closure member unless and until the operator chooses to set the member in a particular open position. "Setting" or positioning the member in the particular open condition is accomplished by stopping the opening action and releasing the door to return slightly under influence of the door closure biasing means, without touching the door holding unit. Thus, the operator may merely touch the member with his shoulder or hip and position the member open, or release it from a previously set position.

An object of the invention is to provide an improved door holder.

Another object of the invention is to provide an improved door holder that permits the door to usually open and close without restriction and which does not require manual dexterity to set it.

Another object of the invention is to provide an improved door holder that is set by touching only the door itself, and not the holder.

Another object of the invention is to provide an improved door holder than can be attached to existing doors and which operates in conjunction with all door closure mechanisms.

Another object of the invention is to provide an improved door holder that includes easily fabricated interlocking components.

Another object of the invention is to provide an improved door holder that can be installed with existing closure devices and which has means for interconnection with the surrounding structures, the means being adaptable to a wide range of dimensional conditions.

In accordance with a particular embodiment of the invention, these objects are achieved with a door holder having an outer housing connected to a door or other closure member, and catch housing connected to the adjacent frame or jamb. A catch device within the catch housing is a cam follower designed to cooperate with a cam surface on the outer housing. The catch device is adapted to be "set" in at least one position that renders it either operative to hold the door in a particular position, or to permit unrestricted movement. Setting includes merely stopping the door at the general position to be maintained, when the catch device generates an audible signal.

In further embodiments of the invention, several interconnecting components are used to develop the outer housing and catch housing of a door holder. The components are structured and slotted to affect engagement during operation of the door holder. These components include integrally related fastening means for connection with the door and/or jamb, which permit pivoting and extension within broad dimensional criteria.

The above, and other objects of this invention will be more clearly understood and appreciated from the following detailed description, taken in conjunction with the drawings.

DETAILED DESCRIPTION OF THE INVENTION

Figure 1:
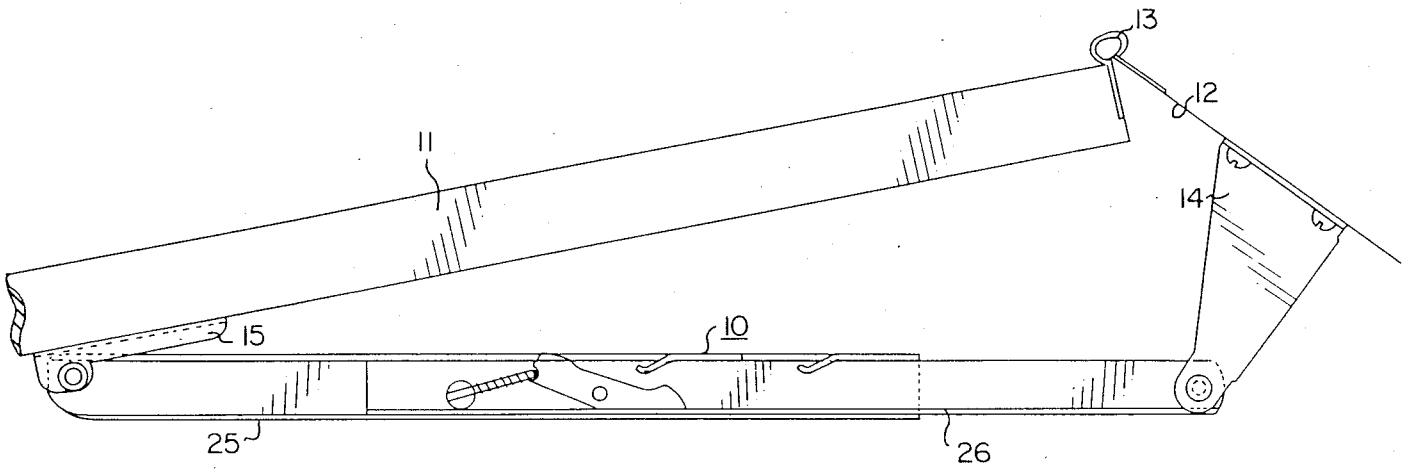
FIG. 1 is a schematic illustration of an embodiment of the invention connected between a door and jamb.

Referring to FIG. 1, it will be seen that door holder 10 is adapted to be mounted between a door 11 and jamb 12. The door is adapted to rotate about jamb 12 by hinge member 13. Although not shown, it is to be understood that the door is biased to a normally closed condition by either a spring, hydraulic closer, gravity, or some equivalent means. Door holder 10 is pivotally connected to door 11, by a door mounting element 15. It is also pivotally mounted to the jamb by jamb mounting element 14. As will be evident from the following description, the door holder has cooperating elements consisting of an outer housing 25 and catch housing 26 which are adapted to telescopically cooperate permitting respective camming surfaces to carry out the features of the present invention.

Figure 2:
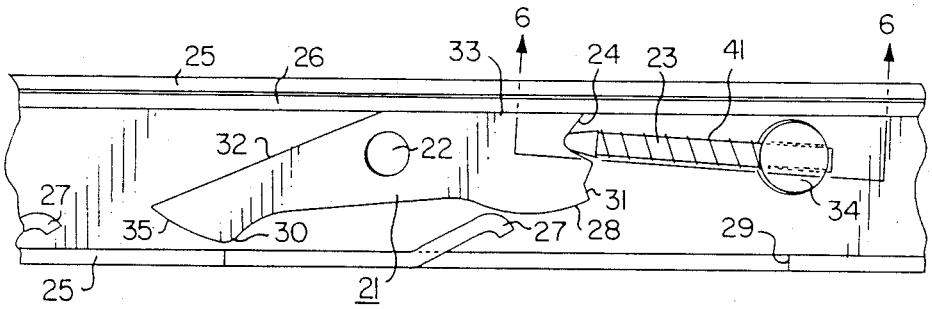
FIG. 2 is an enlarged view showing the internal mechanism of an embodiment of the invention as the catch is cocked ready to either permit further opening of a connected door, or to permit the door to close without impediment.
Figure 3:
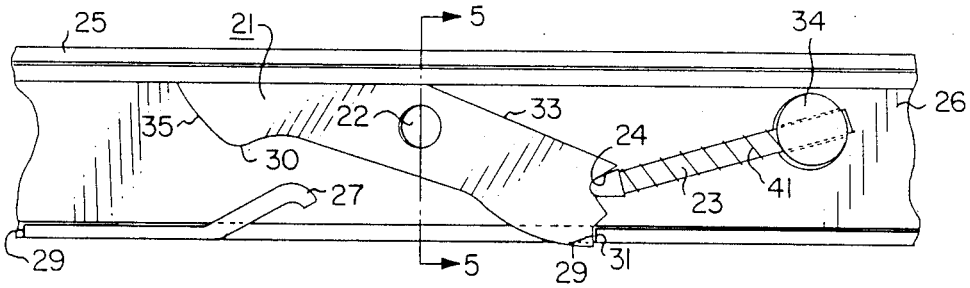
FIG. 3 is an enlarged view of an embodiment of the invention wherein the catch is engaged at a track stop surface, holding the door open in a selected position.
Figure 5:
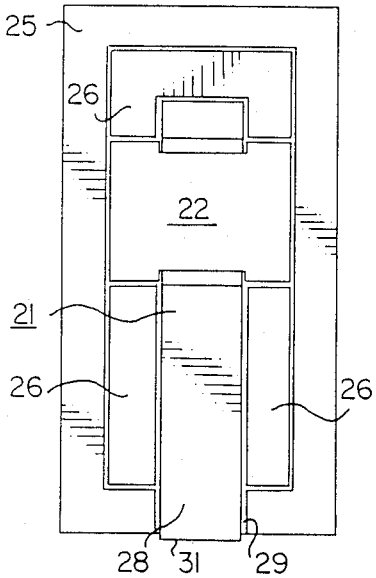
FIG. 5 is a cross-sectional view taken along the lines 5—5 of FIG. 3.
Figure 7:
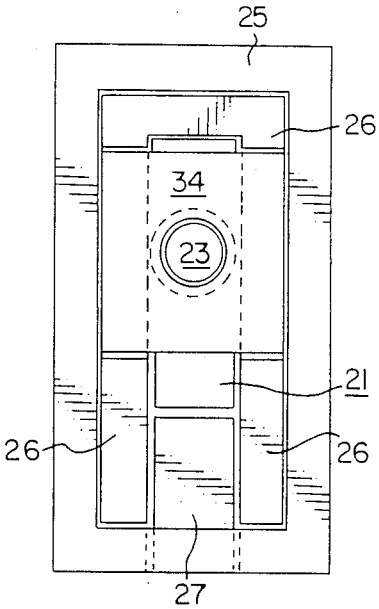
FIG. 7 is a cross-sectional view of the spring pin and swivel assembly taken along lines 7—7 in FIG. 6.
Figure 4:
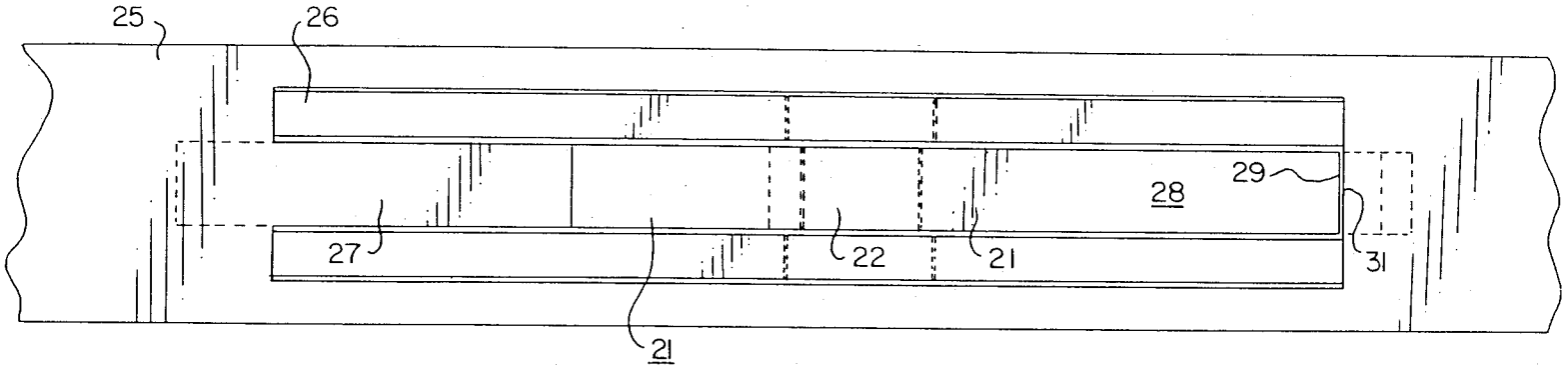
FIG. 4 is a side view of the preferred embodiment of the invention, showing the portion of the device in FIGS. 2 and 3, with the catch element over a stop opening.
Figure 6:
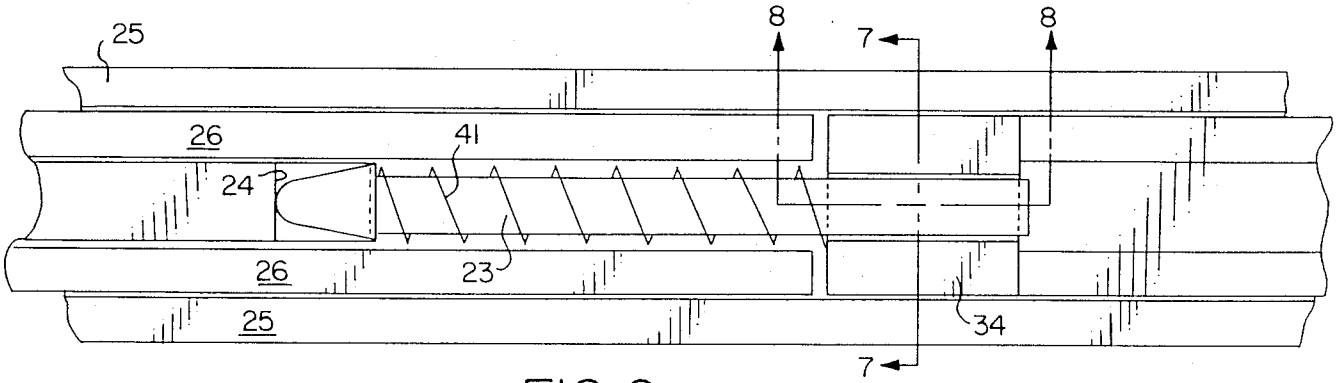
FIG. 6 is a cross-sectional view of the spring pin assembly taken along lines 6—6 in FIG. 2.

FIGS. 2 and 3 illustrate separate positions of the outer housing and catch housing when the door is in different positions. These FIGURES should be considered together in order to appreciate a typical operating sequence.

When door 11 is closed, catch 21 resides in a quiescent condition cocked with its leading surface 33 resting against the inner surface of catch housing 26. It is held in this position by pressure at the spring pin notch 24, exerted by spring pin 23. This pressure is achieved due to the compression of spring 41.

As the door is opened, the catch sliding cam surface 28 moves against the inside surface of outer housing 25. When the door reaches a predetermined hold position (either 30°, 45°, or some other position selected by the location of a notch in the outer housing 25) catch 21 drops into the slot coming to a stop with an audible click as the catch back surface 32 of catch 21 comes into contact with the inside surface of catch housing 26. If the door is released at this time, catch lock surface 31 will come into contact with track stop surface 29 and hold the door fixed. If this position is 30 or 45 degrees, it will allow medium-sized packages to be passed through the door. Where the door is a hatch cover, it may be a position established to provide ventilation.

By continuing to move the door further in an open direction, the catch 21 automatically releases as cam follower surface 28 moves over the cam surface 27. Thereafter, if the door is released while the follower is in this condition, it will proceed unimpaired back to a closed condition.

If it is not desired to hold the door open, catch 21 will continue sliding back on surface 32 until the cam surface 28 contacts track cam 27 causing the spring pin 23 to move up with the catch until the spring pin notch 24 is above the center of both the catch locking pin 22 and the spring swivel 34. Under these conditions, the catch leading surface 33 will engage the inner surface of catch housing 26 and the door will be free to close. When the catch lock surface 31 is in an up position, it passes over track stop surface 29 as the door closes, until the trigger cam surface 30 contacts track cam 27 flipping the catch back down on sliding surface 28 and back to its original starting position where it is cocked and ready to either hold the door open or make another passive "round-trip".

In order to hold a door all the way open, a second track stop surface 29 is provided in the outer housing 25. After the first track cam 27 is passed, and the catch 21 is cocked upwardly, it will slide with its leading surface 33 upward and its trigger cam surface 30 downward. When catch 21 approaches the second track slot, trailing cam surface 35 will contact track cam 27 flipping the catch 21 down so it can drop into the second slot and make contact between the catch lock surface 31 and track stop surface 29. In order to release the door from this second open position, it is simply pushed slightly further forward pulling catch 21 over track cam 27 to again cock it into an upward position. Now, the door can be released and it will travel the entire trip back to a closed condition.

To more fully understand the important features of the invention and the interrelated structures that cooperate to achieve the objectives of the invention, consideration will be given to a number of the critical elements. These elements are shown enlarged in FIGS. 5 through 8.

The catch 21 is the locking member between the inner catch housing 26 and the outer housing 25. It is attached by a catch locking pin 22 to the catch housing. All movements of the catch 21 are fully automatic. They are controlled by simply the opening and closing of the door. In one embodiment there is a choice of two holding positions; however, the features of the invention are useful and effective for any number of positions from one, to a plurality. When two positions are contemplated, the first might secure the door halfway open and the second might secure the door in a fully opened position. Each "hold" position is located by an audible click. By releasing the door at this point it is automatically set into the "hold" position. In order to release the door, it is moved a few degrees, or few inches, beyond the "hold" point providing the clicking sound again, and cancelling the "hold" action from taking place.

Catch holding pin 22 is provided to hold the assembled elements of the catch and housing together. This can be seen more clearly in the cross-sectional view of FIG. 5. When the catch 21, catch locking pin 22, spring pin 23, spring pin swivel 24, and spring 41 are assembled in proper sequence, the assembly remains interconnected without the possibility of dis-assembly until physically taken apart. In order of assembly, the catch 21 is positioned within housing 26; catch locking pin 22 is inserted within the catch; spring 41 is then mounted upon pin 23 and the pin is positioned within the aperture in swivel 34. Pin 23 is then engaged within notch 24. The swivel 34 is held in place by the width of spring pin 23 and spring 41, which in turn are locked between swivel 34 and the notch 24. Catch spring pin 23 transfers the pressure of spring 41 to catch 21 in order to keep it at all times either in an up (open) or down (cocked) position against outer housing 25. The front portion of spring pin 23 fits into the spring pin notch 24 in catch 21 and provides an area for the spring 41 to push against.

The swivel 34 allows spring pin 23 to move up and down with catch 21. It rotates with spring pin 23 and the associated spring 41, providing a backstop for the spring and allowing pin 23 to move backward and forward as well as up and down. As noted previously, an important function of swivel 34 is to provide means for easy assembly of the catch and cocking components.

The inner catch housing 26 slides with a telescoping action inside outer housing 25. It is the mounting vehicle for the catch and spring pin assembly. It attaches to the door jamb and by its action with catch 21, engages to lock with the outer housing 25 when the door is in one of the "hold" positions.

There may be several embodiments of outer housing 25. These depend upon the particular type of closure device employed on the door. For example, a spring may be mounted between the door mounting element and jamb mounting element. Alternatively, the type of hydraulic closer disclosed herein may be provided between these elements.

Figure 11:
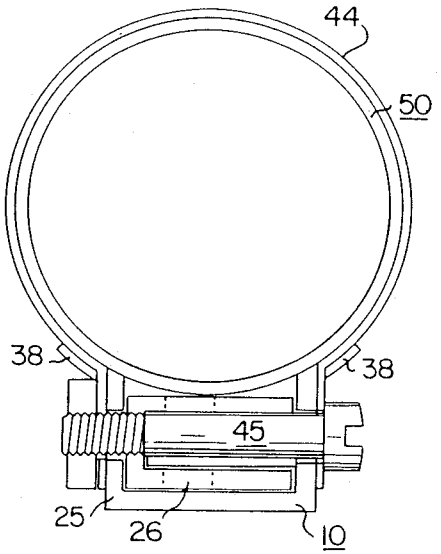
FIG. 11 is a cross-sectional view taken along lines 11—11 in FIG. 9.
Figure 10:
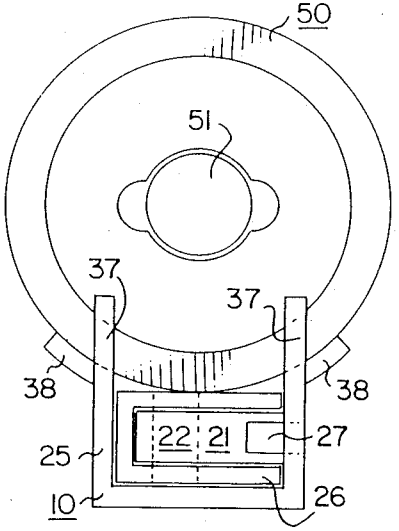
FIG. 10 is a cross-sectional view taken along lines 10—10 in FIG. 9.
Figure 8:
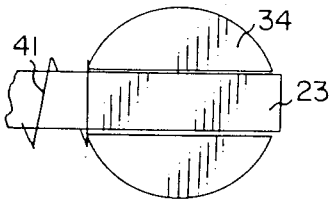
FIG. 8 is a cross-sectional view of the spring pin and swivel assembly taken along lines 8—8 in FIG. 6.
Figure 9:
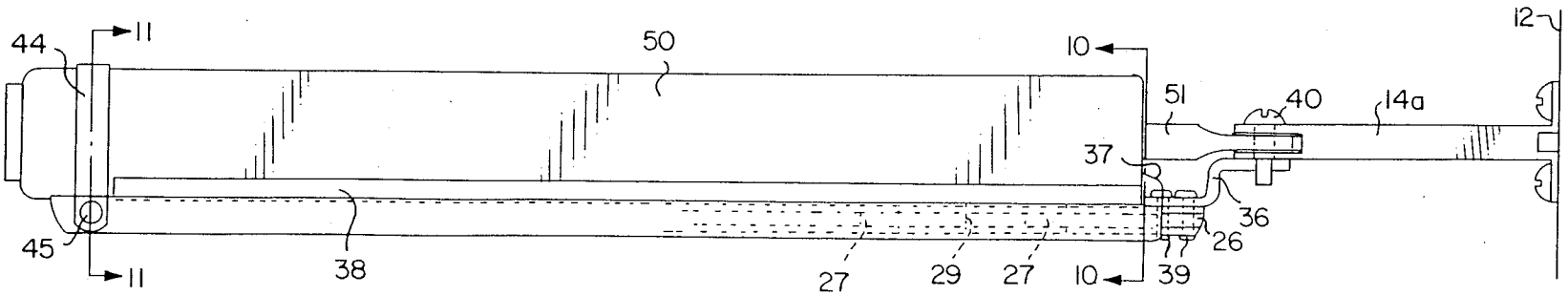
FIG. 9 is a side view of an embodiment of the invention, showing the control mechanism in combination with a hydraulic closure device.

FIGS. 9–11 illustrate the mounting of the mechanism of this invention in conjunction with a typical hydraulic closure cylinder 50. It will be understood that such cylinders are designed to return any opened door or cover to a desired closed position.

Cylinder 50 is pivotally connected via arm 51, and pin 40, to jamb mounting bracket 14*a*. As the door element is opened, arm 51 extends within cylinder 50. The outer housing 25 of the holding mechanism of the invention is affixed to the bottom of the cylinder 50, as shown if FIG. 9. Shoulder 37 rests against the rear of cylinder 50, and absorbs the force exerted against the unit when the door is held open, thereby relieving any strain on the connection between the housing 25 and closure cylinder 50. Bracket 36 rigidly connects the catch housing 26 to a threaded portion of pin 40. And thus to the jamb mounting bracket 14*a*.

The outer housing 25 is preferably attached to cylinder 50 along its longitudinal dimension, by mounting flanges or strips 38. These flanges may be flexible or rigid elements provided with adhesive coating to assure simple and aligned connection between the parts. For additional mounting security, a band 44 may be used at the remote end of cylinder 50.

As described herein, the door holder of the invention comprises an outer housing 25 carrying catch housing 26, with catch 21 that selectively engages the outer housing to: (1) hold door 11 open; (2) release the door after it has been held open; or (3) self-cancel, indefinitely, all inter-action with the door position. FIGS. 12–24 illustrate a typical sequence of catch operations as a door is moved. Each FIGURE includes a small schematic showing the general position and direction of door movement when the catch and outer housing are in particular relative positions.

Figure 12:
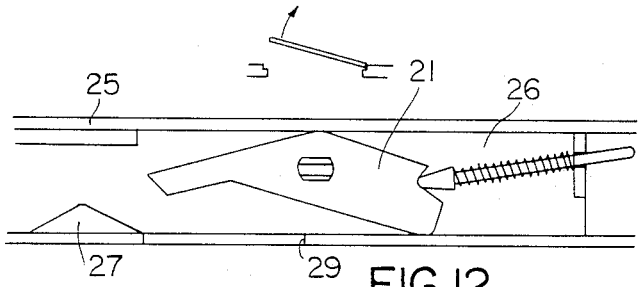
FIGS. 12-24 comprise schematic illustrations arranged in sequence to show the position of the catch element of the invention, as a door is opened.

FIG. 12: Door starts to open.

Figure 13:
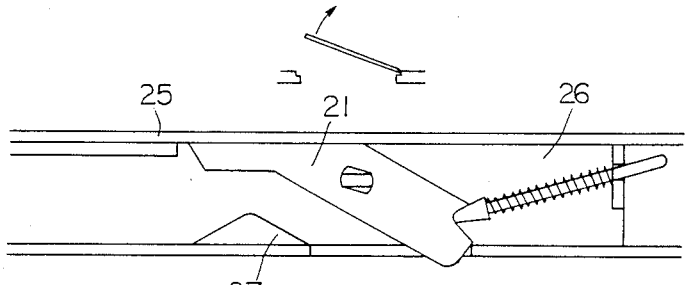

FIG. 13: Catch 21 snaps down into the notch in outer housing 25 making an audible click as the back of the catch strikes the inside of the housing. If the door is now released, it will remain open at this position.

Figure 14:
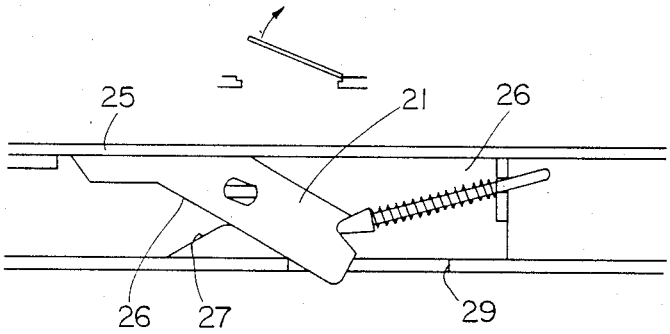

FIG. 14: The door continues opening, bringing cam surface 28 into contact and register with the surface of track cam 27.

Figure 15:
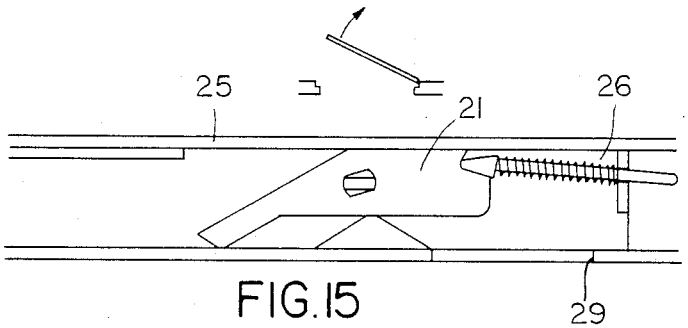

FIG. 15: The door continues opening. Catch 21 is pushed up against the inner surface of housing 25, and held there by the action of spring pin 23. The door "hold" function is thus cancelled and the door is free to close, because catch 21 will pass over the notch in the outer housing 25 before the track cam surface (tripper) 27 can flip the catch back down.

Figure 16:
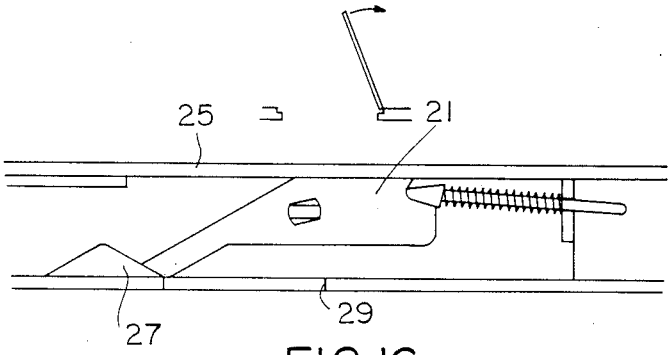

FIG. 16: The door continues opening and the holder approaches a second "hold" position.

Figure 17:
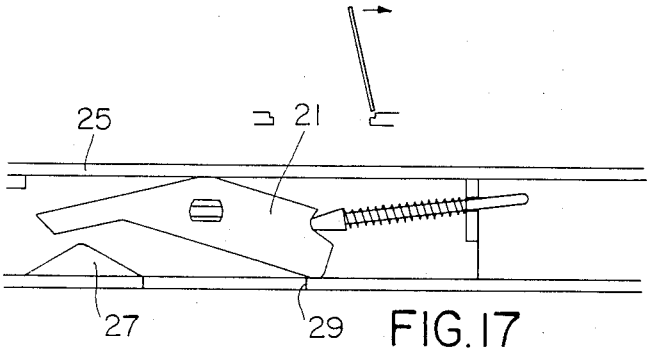

FIG. 17: The door continues opening and the second track cam surface 27*a* flips the catch 21 down.

Figure 18:
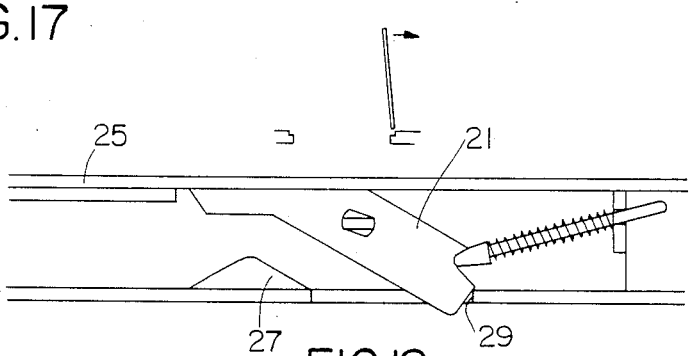

FIG. 18: The door continues opening and the catch 21 drops into the second notch in the outer housing 25.

Figure 19:
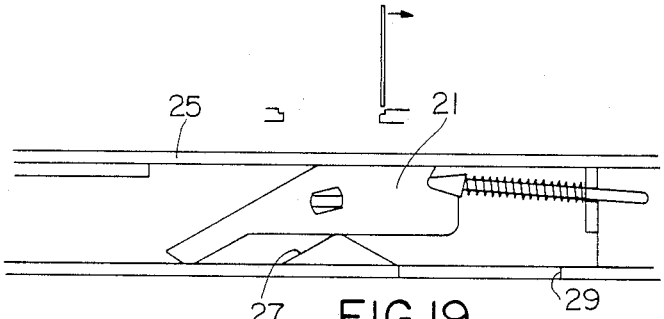

FIG. 19: The door is fully opened and catch 21 is flipped into an open position ready to return over the track cam surfaces 27, 27*a*.

Figure 20:
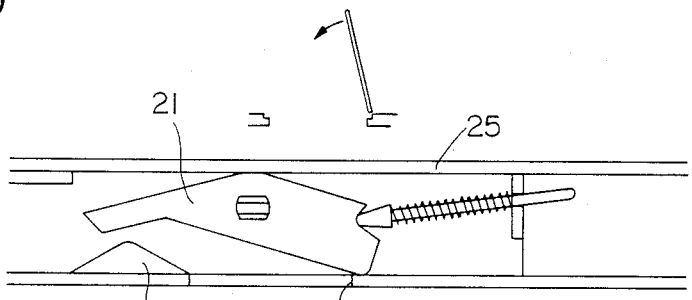
Figure 21:
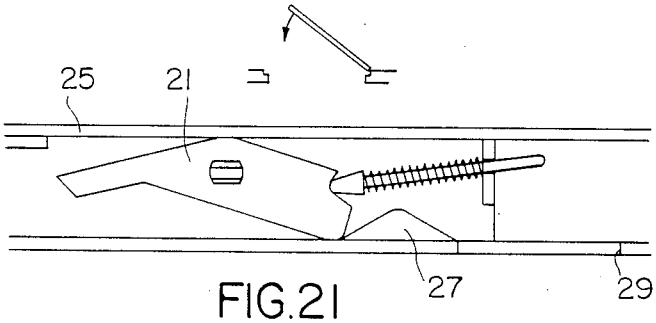
Figure 22:
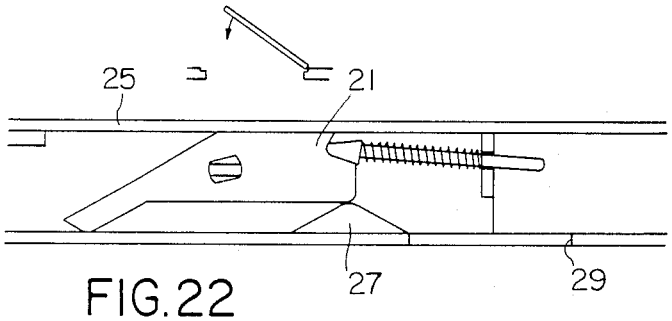
Figure 23:
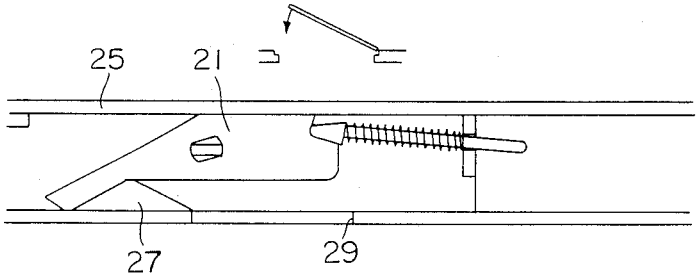
Figure 24:
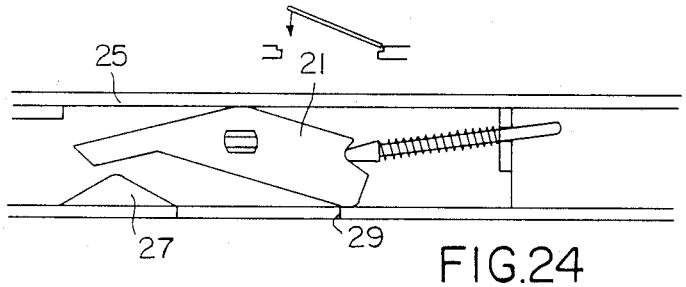

FIG. 20: The door starts to close.

FIGS. 21–24: The door closes and catch 21 is activated to pass over track cam 27 and the notches in outer housing 25, until the door is completely closed.

Figure 25:
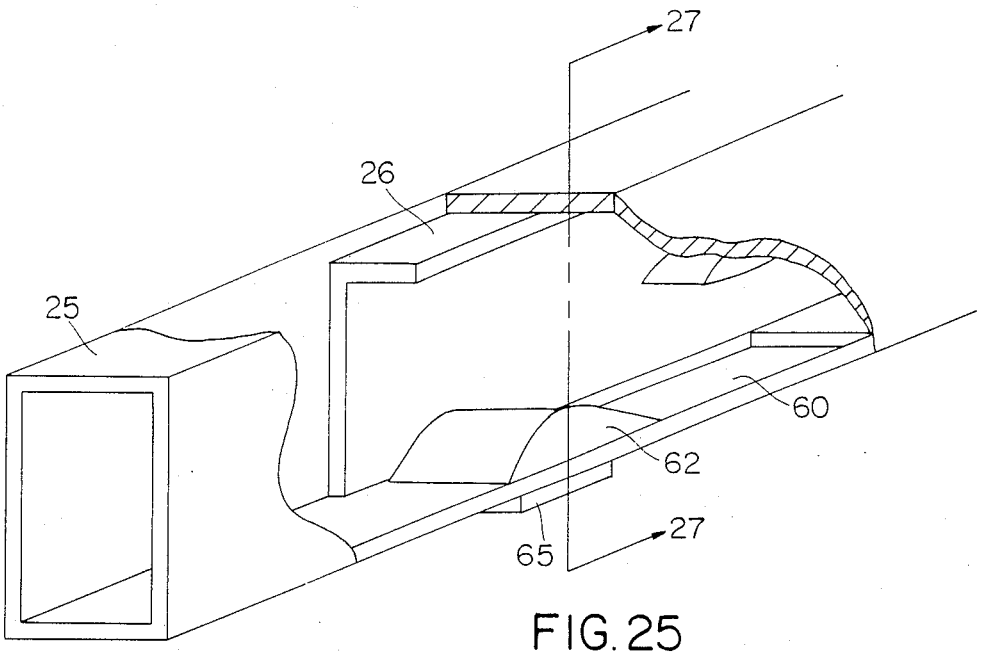
FIG. 25 is an enlarged perspective view showing the structure and mounted relationship of the outer housing, catch housing, and a track cam element in a particular embodiment of the invention.
Figure 26:
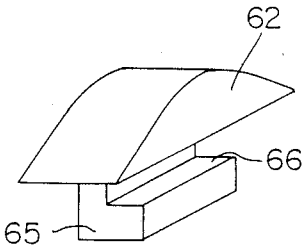
FIG. 26 is a perspective view of the track cam shown in FIG. 25.
Figure 27:
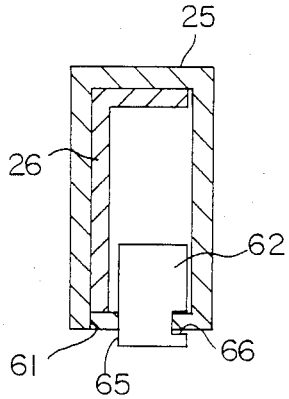
FIG. 27 is a cross-section view taken along line 27—27 in FIG. 25.

While the interaction of the components is fundamental to the invention, so too are the specific sizes and shapes of several of these components. By unique design, with attention to the features and objectives of the invention, particular embodiments have been developed. FIGS. 25–27 show a preferred embodiment wherein the outer housing 25, catch housing 26, and track cam surface 27 take important forms. Outer housing 25 is an elongated unit with a substantially rectangular cross-section. Catch housing 26 is also elongated and comprised orthogonally disposed surfaces that are slidingly assembled within outer housing 25; the surfaces being in contact with two inner walls of the outer housing. One wall of the outer housing, not contacted by the catch housing, has two slots 60, 61. Slot 60 corresponds to the notches discussed above. Slot 61 is provided for mounting a tripper cam 62 that functions as the previously described track cam surface 27.

As seen in FIGS. 26, 27 cam 62 has camming surfaces 63, 64 with which catch cam 21 interacts. Cam 62 has a width approximately equal to the space remaining within outer housing 25, when catch housing 26 is assembled. Slot 61 is slightly larger than this width and it is disposed in the outer housing, directly below the depending leg of the catch housing.

Projection 65 has a groove 66 with a depth similar to that of the wall of outer housing 25. The dimensions of the projection are such that it nests within slot 61 with groove 66 engaging the lower wall portion of housing 25. Contact of catch housing 26 with one wall of the tripper cam, thus holds the cam in position. During operation of the door holder, interaction of the tripper cam and catch 21 will be appreciated from the previous discussion.

Recall that this door holder is interconnected between a door jamb and a door. In each instance, the connections require pivoting support. In addition, the invention is used in conjunction with known door closure devices such as hydraulic cylinders. It has been found that unique means for mounting the door holder to both the door and the door jamb optimize the utility of the invention, increase its versatility, and assure universal application.

Figure 28:
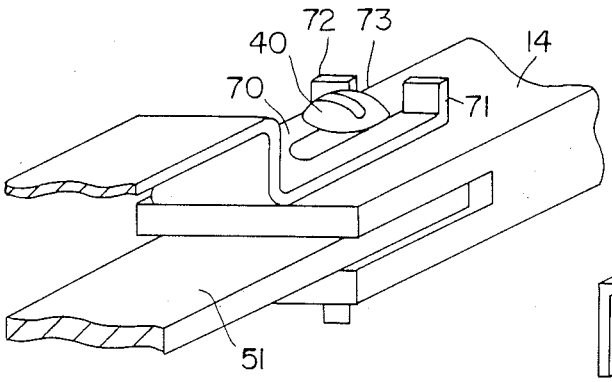
FIG. 28 is a perspective view of the holder/jamb connection in accordance with a particular embodiment of the invention.

FIG. 28 illustrates a specific interconnection structure to connect the catch housing 26 with the jamb mounting element 14 shown , for example, in FIG. 1. Generally, a hydraulic cylinder of the type suggested in connection with FIG. 9, will also be connected to the mounting element 14. Such cylinders create pressure and therefore will generate tension against the mounting pivot 40 in FIG. 9. Rather than assembling the door holder on the bottom of such a cylinder, another embodiment contemplates mounting it along the top of the cylinder with the interconnection system shown in FIG. 28.

In FIG. 28 an extending member 70 projects from catch housing 26. Member 70 is turned upward at the remote end creating extending fingers 71, 72 with a separating slot 73. Thus, in order to interconnect catch housing 26 to the jamb mounting element 14, one need simply loosen the pivot pin or screw 74, insert the projection 70, and then nest pin 74 as shown in the FIGURE. When this configuration of components is used, it is unnecessary to disconnect an already mounted hydraulic cylinder 50.

Figure 29:
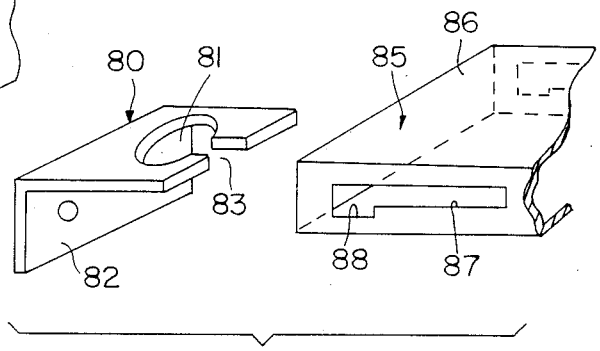
FIG. 29 is a perspective view of the holder/door connection in accordance with a particular embodiment of the invention.

Attention is now directed to FIG. 29 which is concerned with mounting the door holder to a door mounting element 15. Here too, simplicity and flexibility (with regard to position) is important. The exploded view of FIG. 29 illustrates the hollow remote end 86 of outer housing 25. A slot 87 is disposed on the opposing surfaces of the housing. One end of each slot has a depending portion 88. This configuration is adapted to interact with a bracket 80 mounted upon door 11. A key aperture 81 on the bracket, is configured to permit either sidewall of housing 25 to fit within opening 83. When assembled, the outer edge of key slot 81 engages within the depending portion 88 of the interconnected catch housing and thereby provides a pivot. This interconnection may be made with either wall of the catch housing.

Particular embodiments of the invention have been shown and described. Modifications of these embodiments will be apparent to those skilled in the art. All such modifications coming within the scope of the following claims are intended to be covered thereby.

What is claimed is:

1. A door holder for selectively positioning a door, comprising means for biasing said door to a closed condition, first and second telescopingly engaged housings, said first housing having at least one stop surface at a particular location to establish a particular door position, said second housing having a cam follower pivotally connected to engage said stop surface, said first and second housings being pivotally connected between said door and a fixed surface, said stop surface and said cam follower having cooperating camming surfaces that are maintained disengaged at all times except when said door is released during opening while said cam follower is at the location of said stop surface; actuating means for maintaining said cam follower in either of two stable conditions, the first of said conditions yielding unrestricted passage of said cam follower past said location, and the second yielding contact between said cam follower and said stop surface;

said actuating means comprising a separately mounted and removable cam element rigidly mounted with said first housing and in the path of said cam follower during telescopic translation of said second housing within said first housing, said cam element having a projection extending through a wall of said first housing and a groove within said projection to engage said wall and including a reset surface to reset said cam follower to said first condition.

2. A door holder as defined as in claim 1, including means operative to produce an audible sound when said cam follower moves into proximity with said particular locations.

3. A door holder as defined in claim 1, wherein each said particular location is defined by a gap in a continuous cam surface.

4. A door holder as defined in claim 3, wherein said stop surface is at the leading edge of said gap.

5. A door holder as defined in claim 4, wherein said cam element is at the trailing edge of said gap.

6. A door holder as defined in claim 5, wherein said cam element surface is interposed into the path of said cam follower during opening and closing of said door.

7. A door holder as defined in claim 1, wherein said first housing is hollow and substantially rectangular in cross-section, including means for pivotally connecting the remote end of said first housing to said door comprising, a bracket mounted to said door, a keyed slot in said bracket, slotted apertures within opposing walls of said first housing having a depending portion at the remote end thereof, the dimensions of said slotted apertures being such to nest the remote end of said first housing pivotally within said keyed slot.

8. A door holder as defined in claim 1, wherein said second housing includes means for pivotally connecting the remote end thereof to said fixed surface, comprising a pair of separated projecting arms with orthogonally extending fingers, and a pin pivotally interconnecting said biasing means to said fixed surface, said pin being nested within the separation between said arms and secured by said fingers.

* * * * *